US011802676B1

(12) United States Patent
Lei

(10) Patent No.: US 11,802,676 B1
(45) Date of Patent: Oct. 31, 2023

(54) ART LAMP, DECORATIVE LAMP, AND LAMP STRING COMPRISING THE SAME

(71) Applicants: Dongguan Miray E-Tech Co., Ltd, Dongguan (CN); Guangdong Jiaduowang Lighting Tech Co., Ltd, Guangdong (CN)

(72) Inventor: Ziyang Lei, Dongguan (CN)

( * ) Notice: Subject to any disclaimer, the term of this patent is extended or adjusted under 35 U.S.C. 154(b) by 0 days.

(21) Appl. No.: 18/146,477

(22) Filed: Dec. 27, 2022

(30) Foreign Application Priority Data

Jul. 25, 2022 (CN) ..... 202221935136.8
Sep. 23, 2022 (CN) ..... 202211178193.0

(51) Int. Cl.

| | |
|---|---|
| ***F21V 3/06*** | (2018.01) |
| ***F21V 23/00*** | (2015.01) |
| ***F21V 17/10*** | (2006.01) |
| ***F21V 5/04*** | (2006.01) |
| ***F21W 121/00*** | (2006.01) |
| ***F21Y 115/10*** | (2016.01) |

(52) U.S. Cl.
CPC ..... *F21V 3/06* (2018.02); *F21V 5/04* (2013.01); *F21V 17/10* (2013.01); *F21V 23/002* (2013.01); *F21W 2121/00* (2013.01); *F21Y 2115/10* (2016.08)

(58) Field of Classification Search
CPC ..... F21V 3/04–063; F21V 5/04–048; F21V 17/10; F21V 23/001–007; F21W 2121/00; F21Y 2115/10
See application file for complete search history.

(56) References Cited

U.S. PATENT DOCUMENTS

| | | | | |
|---|---|---|---|---|
| 5,803,580 | A * | 9/1998 | Tseng | F21S 10/002 362/811 |
| 10,094,550 | B2 * | 10/2018 | Chen | F21V 19/002 |
| 10,184,630 | B1 | 1/2019 | Hua-Cheng | |
| 10,753,595 | B1 | 8/2020 | Wan | |
| 11,175,032 | B1 * | 11/2021 | Yang | F21V 33/0004 |
| 11,371,691 | B2 | 6/2022 | On | |
| 11,525,565 | B1 | 12/2022 | Liu | |
| 2019/0249838 | A1 * | 8/2019 | Wang | G02B 6/0076 |
| 2019/0368670 | A1 | 12/2019 | Shangyou | |

FOREIGN PATENT DOCUMENTS

CN 2852032 Y 12/2006

* cited by examiner

*Primary Examiner* — Jason M Han

(57) ABSTRACT

An art lamp and a lamp string, the art lamp includes a light head, a wire and a light shell. The light head is provided with a power board; the wire passes through a top of the light head to connect with the power board; the light shell filled with a transparent liquid or gel-like medium, at least one decorative piece is disposed in the medium. The lamp string includes a multi-wire conductor and a plurality of art lamps. One end of the multi-wire conductor has multiple wires, the other end thereof has a plug electrically connected to the multiple wires, each of the wires is connected with one of the light heads of the art lamps. The light of the a first LED lamp beads on the power board illuminates the light head, the medium and the decorative piece to present a decorative pattern.

18 Claims, 13 Drawing Sheets

ART LAMP, DECORATIVE LAMP, AND LAMP STRING COMPRISING THE SAME

FIELD OF THE INVENTION

The present invention relates to the technical field of lamps, and more particularly, relates to an art lamp, a decorative lamp and a lamp string comprising the same.

BACKGROUND OF THE INVENTION

Lamps are lighting source for light and heat through electric energy. Since the invention of lamps, they have greatly promoted the development of human beings, they illuminate for human beings at night or in dark room, so that human being can move as night just like in daytime, they are indispensable lighting appliances. However, as the development of science and technology, lamps are not only used for illumination, light from lamps can change the atmosphere of the whole indoor environment, or bright and full of energy, or warm and romantic, effecting the feelings of people living in this indoor environment.

Art lamps are used for decoration indoor and outdoor, stage, bars and other places. By changing the flash mode, the light degree and the color of the lamps, they create a different atmosphere, give people an aesthetic feeling and dynamic feeling, beautify the environment.

However the existing art lamps can not meet people's requirements because of single shape and poor appearance. In addition, the sealing effect between the lamp seat and the bulb is poor. Especially outdoor bulbs are exposed to the sun and rain, which may cause short circuit and fire due to water ingress or may not work normally. The quality of the lamps is poor, and their service lives are short. After the bulbs are damaged, they needs to be replaced in a whole, resulting in material waste, which does not conform to the current concept of energy saving and environmental protection.

The existing lamp are commonly assembled lamp seats making from copper or other metal, lampshade and LED wick. For example, Chinese Patent Application No. CN201420867418.8 discloses a LED lamp of full directional lighting, which includes a drive circuit, which and several LED chips are jointly disposed on a light source substrate to form a luminous body. The luminous body is bent and/or folded into a stereoscopic shape along a slot line disposed on the light source substrate. Wherein, two or more of the bent and/or folded luminous bodies are combined to form an LED filament having a 3 D stereoscopic structure. The above lamp illuminates the environment by the lighting of the several LED chips, although it can play a very good lighting effect, the decorating effect of the above lamp is still relatively ordinary, resulting in the lack of decoration and environmental beautification effects. It also has the short comings of difficult installation and high production costs.

In addition, the lamps are installed on the lamp seats of lamp strings. The lamp seats in a traditional lamp strings are arranged in series or parallel. The traditional lamp strings have the disadvantages of single shape, many wire materials, high production labor costs, which can not meet people's needs for using in various environments.

SUMMARY OF THE INVENTION

One objective of the present invention is to provide an art lamp to solve the technical problems that the lamps in the prior art have the shortcomings about single shape and poor appearance, the sealing effect between the lamp seat and the bulb poor, and the lamps need to be replaced in a whole after the bulbs are damaged, resulting in material waste, etc.

The other objective of the present invention is to provide a decorative lamp, some medium is poured into a light shell, at least one decorative piece is placed in the medium, the aims is to solve the technical problems that the lamps in the prior art lack of decoration and environmental beautification effects.

The third objective of the present invention is to provide a lamp string with the decorative lamps to solve the technical problems that the lamp string in the prior art is single shape, used more wire material, high labor costs, which can not satisfy people's demands for used in various environments.

In order to achieve the above objectives, the present invention adopts the following technical solutions:

An art lamp includes a light head, a wire and a light shell. The light head is provided with a power board with a top surface and a bottom surface, the top surface and the bottom surface are provided with one or several a first LED lamp beads respectively; the wire passes through a top of the light head to connect with the power board with and powers the a first LED lamp beads. The light shell is a transparent shell, a translucent shell, or a white fluorescent shell, which is detachably connected with the light head and filled with a transparent liquid or gel-like medium, at least one decorative piece is disposed in the medium. The a first LED lamp beads illuminates, the light shell, the medium and the decorative piece.

The light head is a transparent shell, a translucent shell, or a white fluorescent shell, the light of the a first LED lamp beads passes through the light head.

Preferably, the light shell is provided with a threaded port, a concave lens is sealed with an inner wall of the threaded port with the concave surface thereof orienting toward the opening of the threaded port.

The concave lens is disposed on a first sealing plug, which is sealing connection with an inner wall of the threaded port.

The concave lens is provided with an exhaust vent and a sealing block matched with the exhaust vent, the sealing block seals the exhaust vent.

Preferably, the medium includes some antifreeze and preservatives.

A top of the light head is provided with a wire column and a column cap. The wire column extends into the light head, the wire column is provided with a wire hole. The column cap is provided with a cap hole, the column cap covers the wire column, the wire passes through the cap hole, an outer wall of the wire attaches to the wire hole and enters the light head. The column cap is filled of sealing glue to seal a gap between the wire hole and the wire, and a gap between the column cap and the wire column, thereby seal connecting the light head and the wire.

Preferably, a centre of the power board is provided with a hole, the wire passes through the hole to be welded on the power board.

The power board is clamped with an inner wall of the light head.

An outer wall of the wire column is provided with a hook, the column cap is provided with an avoiding position at the corresponding hook so that the hook can extend out of the column cap.

The wire includes a transparent wire shell and a positive wire, a negative wire and an emitting wire arranged in the transparent wire shell. The emitting wire includes a transparent protective layer and a second LED lamp beads arranged in the transparent protective layer; the positive wire, the negative wire are electrically connected with the second LED lamp beads and the power board.

Compared with the prior art, one or more technical solutions about the lamp in the present invention has at least one of the following effects:

In the art lamp, the first LED lamp beads are arranged in the light head, the medium and the decorative piece are arranged in the light shell, the first LED lamp beads illuminates the light head, the medium and the decorative piece in the light shell, the light head and the light shell present a beautiful decorative pattern. Wherein, the decorative pieces can be artificial ornaments, such as decoration strips, lovely dolls, artificial flowers and plants, and can also be the flowers, grass, leaves of natural plants, etc. The decorative pieces are various in shape, presenting aesthetic feeling under the illumination of the light. The decorative pieces are placed in the medium. The medium keeps the shape of the decorative pieces unchanged, prevents the decorative pieces from rot and changing color, and maintains the decorative pieces in natural state.

In the art lamp, the light head and the light shell are detachable connected, the light shell can be replaced according to decorative needs of different scenes. If the first LED lamp beads in the light head are damaged, the light head can be replaced, which prolongs the lifetime of the art lamp and achieves the goal of saving money.

The concave lens is arranged in the light shell, which gathers the light of the first LED lamp beads and radiates it to illuminate the medium and decorative piece, making the irradiating effect more bright. The concave lens is sealed with the inner wall of the threaded port, which can seal the medium and the decorative piece and prevent the dust or other substances from entering the light shell, damaging the shape of decorative piece and the effect of the light.

In the art lamp, the column cap covers the wire column, the sealing glue seals the gap between the wire hole and the wire, and the gap between the column cap and the wire column, thereby sealing the light head and preventing mist and dust from entering the light head, affecting the light effect and the lifetime of the first LED lamp beads.

The present invention also provides a decorative lamp, which includes a light shell, a power board and a threaded light head. The light shell has a cavity full of medium, a decorative piece is placed in the medium, an end of the light shell is provided with a connecting ring, a second sealing plug is arranged in the connecting ring and seals with the connecting ring. The power board is arranged in the connecting ring, a surface thereof oriented to the decorative piece is provided with at least one of the first LED lamp beads. The threaded light head covers the connecting ring, and electrically connected with the power board.

The second sealing plug is provided with a mounting slot, the power board is mounted in the mounting slot.

A bottom of the mounting slot is provided with a through hole communicated with the cavity, which is connected with a sealing block.

An edge of the second sealing plug extends outwardly with an annular limiting portion against the opening of the port.

The medium is liquid such as water, oil, resin, etc.

Compared with the prior art, one or more technical solutions about the lamp in the present invention has at least one of the following effects:

The first LED lamp beads on the power board can emit different colors of light, the light illuminates on the decorative piece and the medium, the decorative piece and the medium combine with the light, which shows more gorgeous effect and is beautiful, which makes the decorative lamps present a more beautiful lighting effect. The product plays the function of decorating and beautifying the environment, adding life interests.

The threaded light head can be a connector used in the existing lamp, it is a standard product, the other decorative lamp can connected with the lamp bases of the lamp string used in different types and different scenes, suitable for various environment. And since the other decorative lamp used in the lamp string can be replaced with the threaded light head at any time, People can replace the other decorative lamp with different shapes and the traditional lamp according to their requirements, it is convenient to use.

A lamp string includes a multi-wire conductor and a plurality of decorative lamps described above. One end of the multi-wire conductor has multiple wires, the other end thereof has a plug electrically connected to the multiple wires, each of the wires is connected with a lamp base, each of the lamp base is electrically connected to one of the threaded light heads of the decorative lamps.

The lamp string also includes a multi-foot bracket with a mounting frame, the mounting frame extends around it with multiple branches, at least one of the wires hangs on one of the branches so that multiple of the decorative lamps distributed on the multi-foot bracket.

One end of each of the branches far away from the mounting frame is provided with a fork, each of the forks hangs at least one of the wires.

Each of the wires is provided with at least one S-shaped hook, one end of the S-shaped hook is connected with one of the wires, the other end thereof is hung on branches or buildings.

The multi-wire conductor is provided with a circuit board, one end of the circuit board is provided with a first positive weld hole and a first negative weld hole. A positive electrode and a negative electrode of a cable of the plug are welded to the first positive weld hole and the first negative weld hole, respectively. The other end of the circuit board is provided with a plenty of second positive weld holes and a plenty of second negative weld holes, a positive electrode and a negative electrode of each of the wires are welded to one of the second positive weld holes and one of the second negative weld holes.

The other lamp string includes a multi-wire conductor and a plurality of art lamps described above. One end of the multi-wire conductor has multiple wires, the other end thereof has a plug electrically connected to the multiple wires, each of the wires is connected with one of the light heads of the art lamps.

Compared with the prior art, one or more technical solutions about the lamp string in the present invention has at least one of the following effects:

Multiple of the decorative lamps or the art lamps are connected with the lamp bases respectively to form the lamp string. The lamp string has simple structure and is easy to assemble.

The lamp string can be used in various places indoor or outdoor, the decorative effect is good, and the assemble is simple which is greatly reduced the production and assembling cost.

BRIEF DESCRIPTION OF THE DRAWINGS

In order to more clearly explain the technical schemes in the embodiments of the present invention, the following will briefly introduce the embodiments or the drawings needed in the description of the prior art. It is obvious that the drawings in the following description are only some embodiments of the present invention, For those skilled in the art, other drawings may also be obtained from them without creative labour.

DETAILED DESCRIPTION OF ILLUSTRATED EMBODIMENTS

Figure 1:
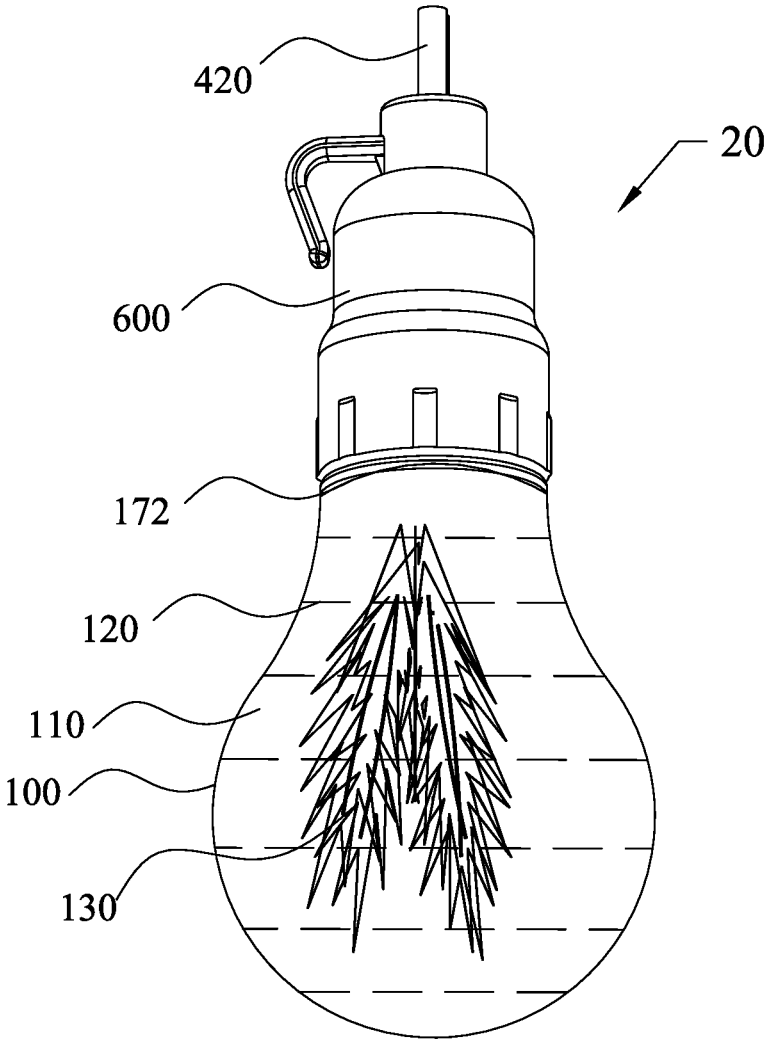
FIG. 1 shows a perspective view of the art lamp according to an embodiment in the present invention.

The embodiments of the present invention will be described in detail below. Examples of the embodiments are shown in the drawings, where the same or similar reference numerals throughout indicate the same or similar elements or elements having the same or similar functions. The embodiments described below by referring to the accompanying drawings are exemplary and are intended to be used to explain the embodiments of the present invention, but cannot be understood as limiting the present invention.

Figure 2:
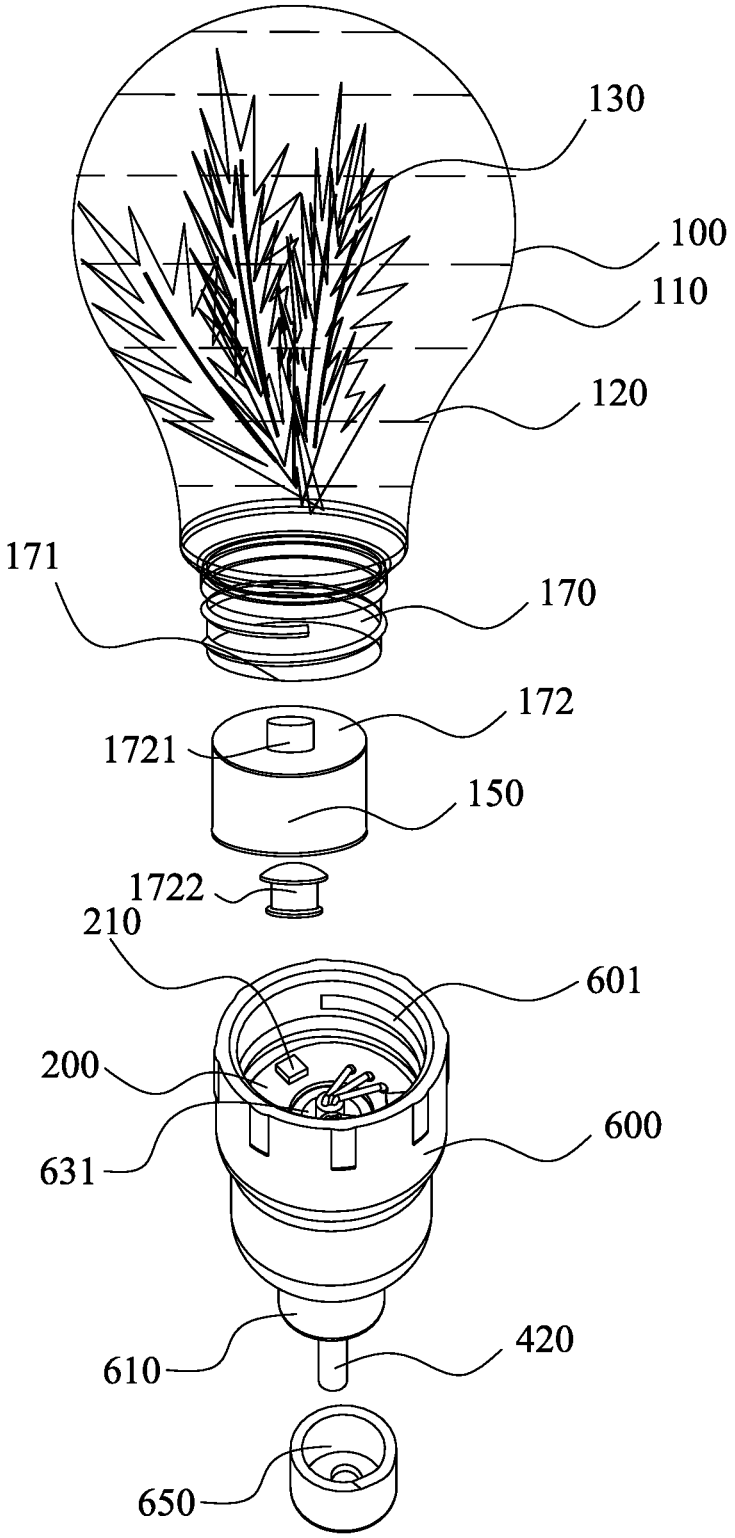
FIG. 2 shows an explode view of the another embodiment of art lamp in the present invention.
Figure 3:
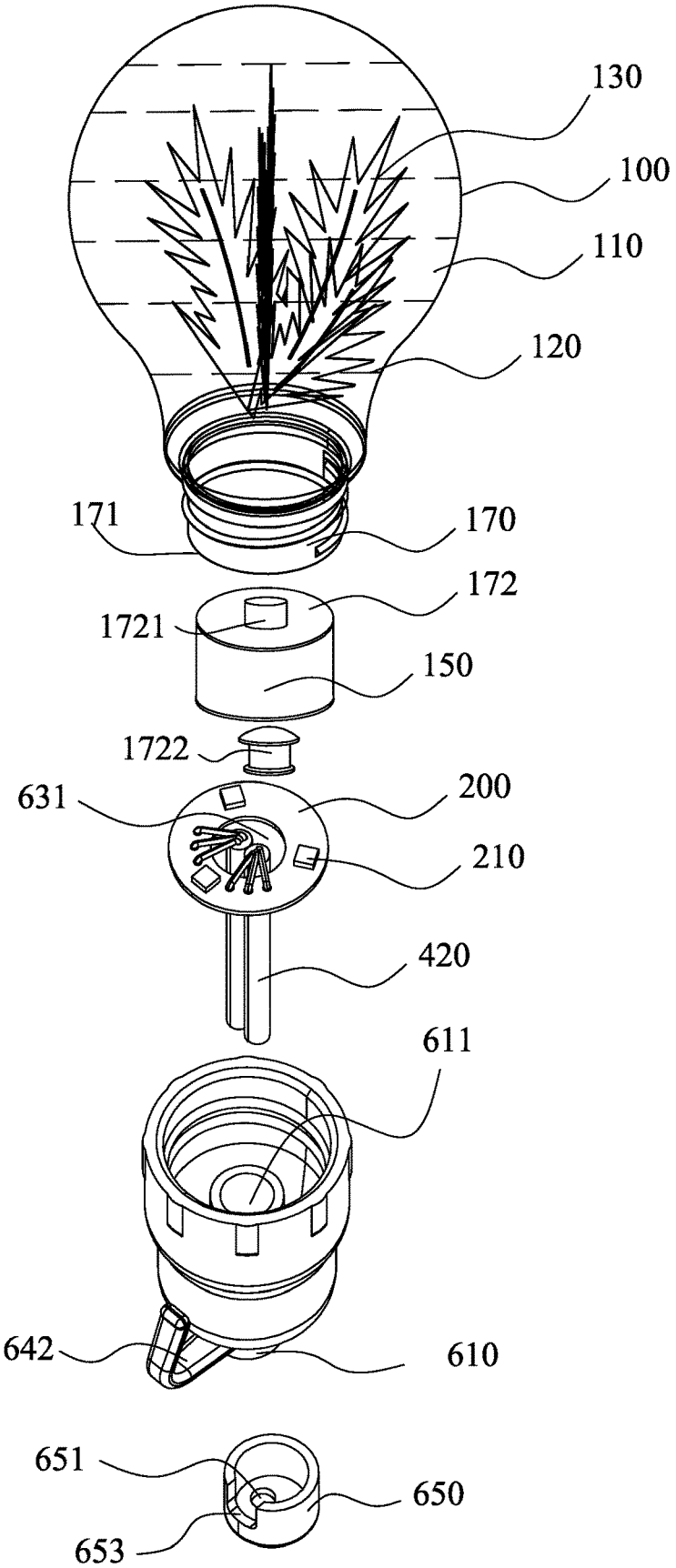
FIG. 3 shows the explode view of the art lamp showing in FIG. 1.

As showing in FIG. 1-3, an art lamp 20 includes a light head 600, a wire 420 and a light shell 100. The light head 600 is provided with a power board 200 with a top surface and a bottom surface, the top surface and the bottom surface is provided with one or several first LED lamp beads 210 respectively. The wire 420 passes through a top of the light head 600 to connect with the power board 200 and power the first LED lamp beads 210. The light shell 100 is detachably connected with the light head 600, the cavity 110 of light shell 100 filled with a kind of transparent liquid or gel-like medium 120, at least one decorative piece 130 is placed in the medium 120. The first LED lamp beads 210 illuminate the light head 600, the medium 120 and the decorative piece 130.

In the art lamp 20, the light head 600 and the light shell 100 are detachable connection, the first LED lamp beads 210 are arranged in the light head 600, the medium 120 and the decorative piece 130 are arranged in the light shell 100, the first LED lamp beads 210 illuminate the light head 600, the medium 120 and decorative piece 130 in the light shell 100 to present beautiful decorative patterns, create a specific atmosphere and give people aesthetic feeling.

Wherein, the decorative piece 130 can be artificial ornaments, such as decoration strips, lovely dolls, artificial flowers and plants, and can also be the flowers of natural plants, grass, leaves, etc. The decorative piece 130 can be various in shape, presenting aesthetic feeling under the light.

The decorative piece 130 is placed in the medium 120. The medium 120 keeps the shape of the decorative piece 130 unchanged, prevents the decorative piece 130 from rot and changing color, and maintains the decorative piece 130 in natural state.

The medium 120 includes some antifreeze and preservatives. The medium 120 may be a solid medium such as a solid paraffin, an epoxy resin, or a liquid medium such as an anticorrosive liquid, or a gel, so that the decorative pieces 130 can float and move therein and present a dynamic effect.

The light head 600 is made from transparent or half-transparent material, or a white fluorescent shell, the light of the first LED lamp beads 210 passes through the light head 600.

Preferably, the light shell 100 is provided with a threaded port 170, a concave lens 172 is sealed with an opening 171 of the threaded port 170 with a concave surface thereof orienting toward the opening 171 of the threaded port 170. The light of the first LED lamp beads 210 illuminates to the concave lens 172, which is radiated by the concave lens 172, a irradiation range of the light and a halo are larger, then the light illuminates the medium 120 and the decorative piece 130, the light is soft and not dazzling. In addition, the concave lens 172 also plays the function of sealing the cavity 110 of the light shell 100 and preventing air, dust or mist etc, from entering the cavity 110 of light shell 100, which will accelerate the corruption of the decorative piece 130 and affect its decorative effect. Preferably, the concave lens 172 is fixed with the inner wall of the threaded port 170 by sealing glue.

In another embodiment, the concave lens 172 is disposed on a first sealing plug 150, which is sealing connection with an inner wall 171 of the threaded port 170. The concave lens 172 is also provided with an exhaust vent 1721 and a sealing block 1722 matched with the exhaust vent 1722, the sealing block 1722 seals the exhaust vent 1721. When the art lamp 20 is assembled, firstly, pour the medium 120 into the light shell 100, and place the decorative piece 130 in the medium 120, then insert the first sealing plug 150 into the threaded port 170, and pour the medium 120 through the exhaust vent 1721 into the light shell to expel the air left in it as much as possible, use the sealing block 1722 to seal the exhaust vent 1721, thus, the assembled light shell 100 is kept in a vacuum state, and the medium 120 and the decorative piece 130 are kept in an optimal state for a long time.

The inner wall of the light head 600 connected to the threaded port 170 is provided with a matching thread 601, the light head 600 and the threaded port 170 are detachable connected by the matching thread 601, it is easy installation and disassembly.

The first LED lamp beads 210 are easy to be damaged because of mist, therefor, the light head 600 must be designed as a sealed structure. Specifically, a top of the light head 600 is provided with a wire column 610 and a column cap 650. The wire column 610 extends into the light head 600, the wire column 610 is provided with a wire hole 611. The column cap 650 is provided with a cap hole 651, the column cap 650 covers the wire column 610, the wire 420 passes through the cap hole 651, an outer wall of the wire 420 attaches to the wire hole 611 and enters the light head 600. The column cap 650 is filled of sealing glue to seal a gap between the wire hole 611 and the wire 420 and a gap between the column cap 650 and the wire column 610, thereby sealing connected the light head 600 and the wire 420, thereby preventing mist and dust from entering the light head 600 through the gap between the column cap 650 and the wire column 610, resulting in the first LED lamp beads 210 being short circuited or damaged, affecting the lifetime of the lamp 20.

The power board 200 is clamped with the inner wall of the light head 600, thereby fixing the power board 200 and the a first LED lamp beads 210. If the first LED lamp beads 210 are damaged, the power board 200 can be replaced and the other parts of the lamp 20 can be used again, thereby saving resources and avoid waste.

The centre of the power board 200 is provided with a through hole 631, the wire 420 passes through the through hole 631 and is welded on the power board 200. The power board 200 is actually a Printed Circuit Board (PCB) with chips to control the flashing mode of the first LED lamp beads 210 to present a dynamic effect.

The outer wall of the wire column 610 is provided with a hook 642 facilitating the fixation and installation of the art lamp 20, and also for removal from the installation position.

The column cap 650 is provided with an avoiding position 653 at the corresponding hook 642 so that the hook 642 can extend out of the column cap 650. It should be understood that as another way, the hook 642 also can be arranged on the column cap 650.

Figure 4:
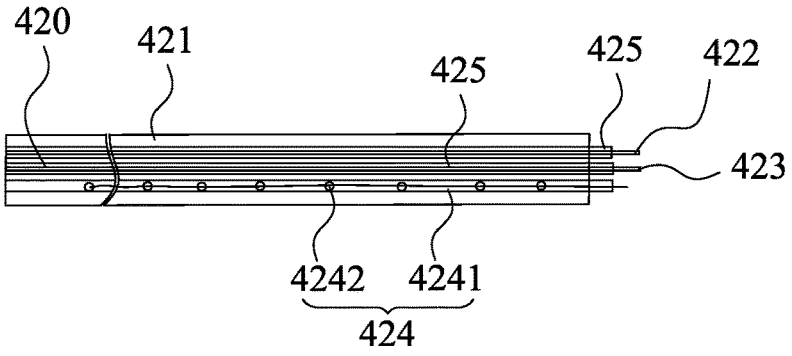
FIG. 4 shows a perspective view of the wire in the art lamp according to an embodiment in the present invention

Referring to FIG. 4, the wire 420 is multi-core illuminated power cord, it includes a transparent wire shell 421 and a positive wire 422, a negative wire 423 and an emitting wire 424 arranged in the transparent wire shell 421. The positive wire 422 and the negative wire 423 are wrapped with a protective insulating layer 425. The emitting wire 424 includes a transparent protective layer 4241 and a second LED lamp beads 4242 arranged in the transparent protective layer 4241; the positive wire 422, the negative wire 423 are electrically connected with the second LED lamp beads 4242 and the power board 200 and power them to make the second LED lamp beads 4242 light.

In an embodiment in the present invention, referring to FIG. 5-14, a decorative lamp 10 includes the light shell 100, the power board 200 and a threaded light head 300.

Referring to FIG. 5, FIG. 8, FIG. 9 and FIG. 10, the light shell 100 can be in a conventional bulb shape, a square shape, a spherical shape, a heart shape, or a bottle structure of any other shape, which is not limited herein.

Figure 5:
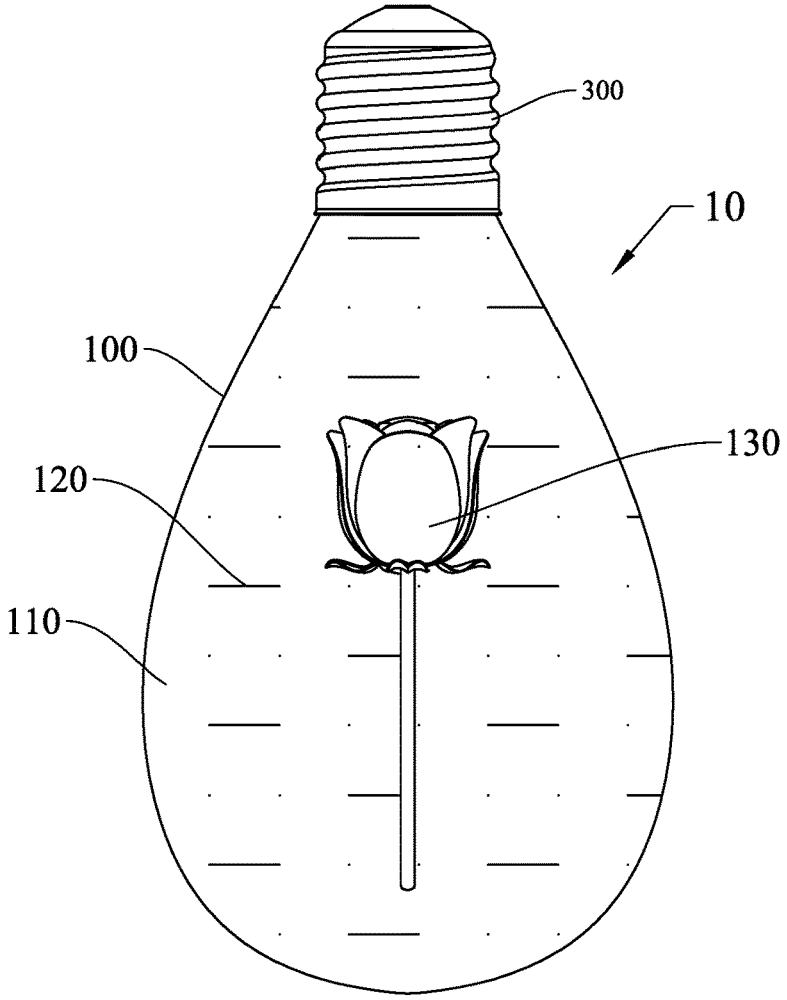
FIG. 5 shows a perspective view of the decorative lamp according to the other embodiment in the present invention.
Figure 6:
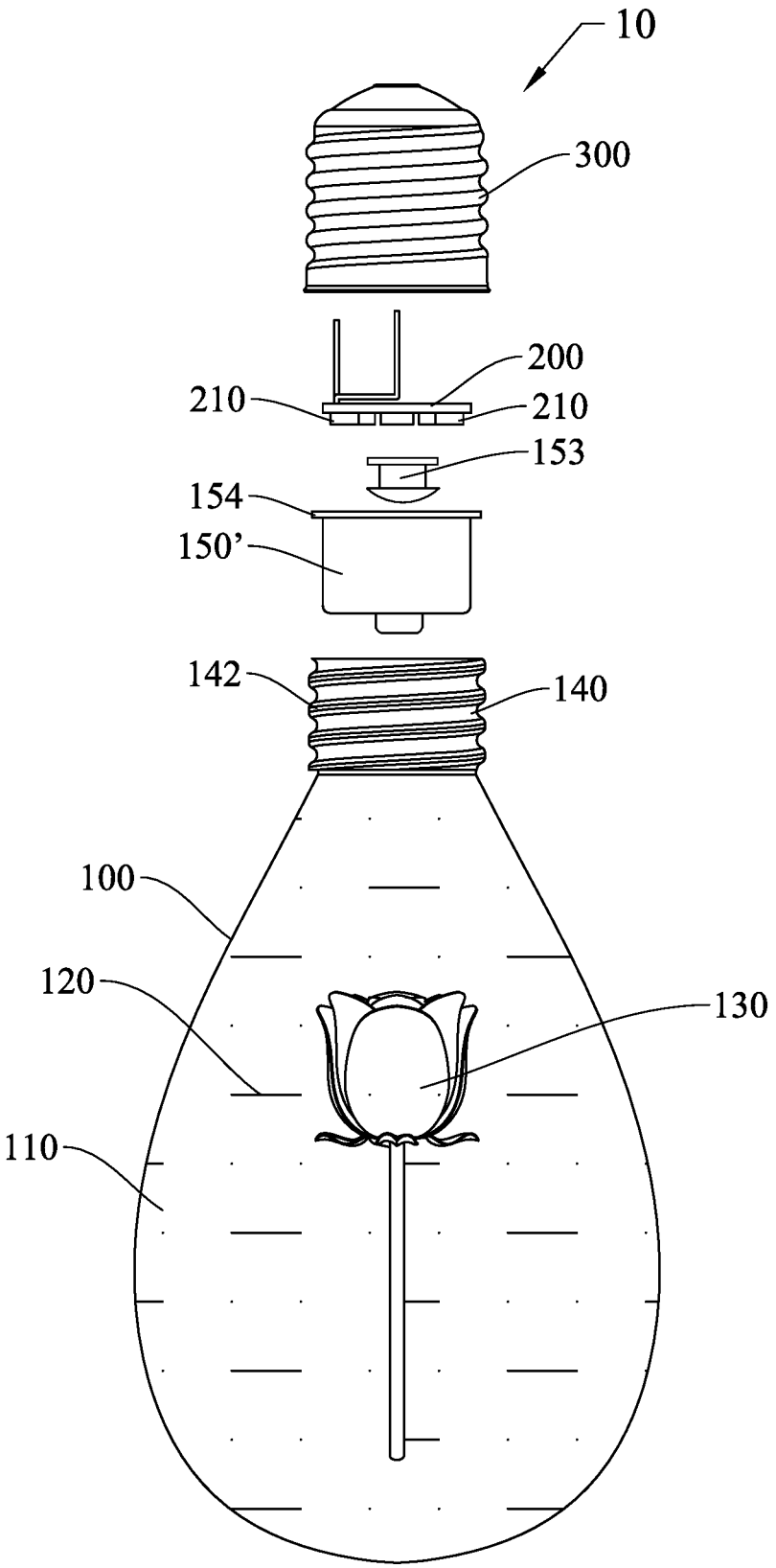
FIG. 6 shows an explode view of the decorative lamp showing in FIG. 5.
Figure 7:
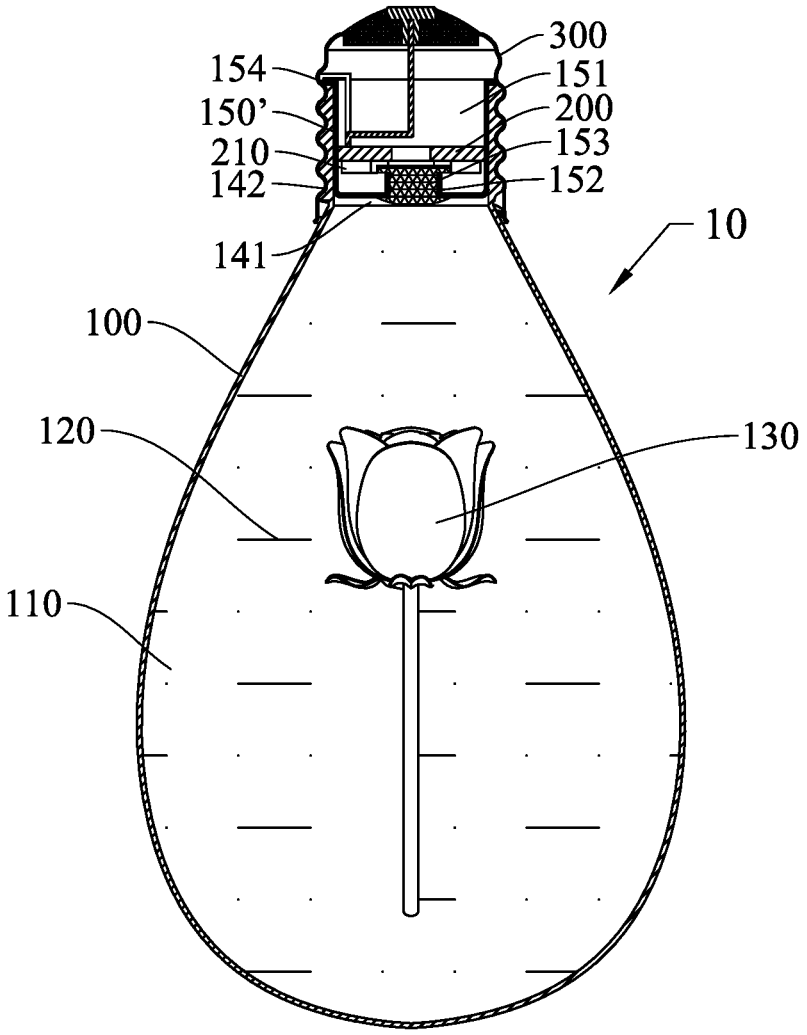
FIG. 7 shows an in-section view of the decorative lamp showing in FIG. 5.

Referring to FIG. 5, FIG. 6 and FIG. 7, the light shell 100 has the cavity 110 full of the medium 120, the decorative piece 130 is placed in the medium 120. Specifically, the decorative piece 130 can be artificial ornaments, such as decoration strips, lovely dolls, artificial flowers and plants, and can also be the flowers of natural plants, grass, leaves, etc, which is not limited herein.

An end of the light shell 100 is provided with a connecting ring 140, a second sealing plug 150' is arranged in the connecting ring 140 and sealed with an inner wall of the connecting ring 140. The power board 200 is arranged in the connecting ring 140, a surface thereof oriented to the decorative piece 130 is provided with at least one first LED lamp beads 210. The threaded light head 300 covers the connecting ring 140, and electrically connected with the power board 200.

Referring to FIG. 5, FIG. 6 and FIG. 7, the cavity 110 may be provided with one or more decorative pieces 130, which are the same or different, or a random combination of the different decorative pieces 130.

Referring to FIG. 5, FIG. 6 and FIG. 7, an end of the light shell 100 is provided with a connecting ring 140, a second sealing plug 150' is arranged in the connecting ring 140 and used for sealing with the connecting ring 140, thereby prevent the medium 120 and the decorative piece 130 from flowing out of the connecting ring 140.

Referring to FIG. 5, FIG. 6 and FIG. 7, the power board 200 is arranged in the connecting ring140, a surface thereof oriented to the decorative piece 130 is provided with at least one LED light 210. Preferably, the surface thereof oriented to the decorative piece 130 is provided with a few of the first LED lamp beads 210, which can emit light at the same time, or intermittently or in turn, and can respectively emit different colors of light, the light effect is better.

Referring to FIG. 5, FIG. 6 and FIG. 7, the threaded light head 300 covers the connecting ring 140 and is electrically connected with the power board 200. Specifically, a positive polar and a negative polar of the power light 200 are respectively connected with a positive polar and a negative polar of the threaded light head 300. The threaded light head 300 is connected with one lamp base 430 in a lamp string, which connects with an external power supply, the external power supply supplies the first LED lamp beads 210 on the power board 200 to make the first LED lamp beads 210 glow.

Compared with the prior art, one or more technical solutions about the decorative lamp 10 in the present invention has at least one of the following effects:

Referring to FIG. 5, FIG. 6 and FIG. 7, the first LED lamp beads 210 on the power board 200 can emit different colors of light, the light illuminates on the decorative piece 130 and the medium 120, the decorative piece 130 and the medium 120 combined with the light can show more gorgeous effect, which makes the decorative lamp present a more beautiful lighting effect. The product plays the function of decorating and beautifying the environment, adding people's life interests.

In addition, the threaded light head 300 is a connector used in the existing lamp, it is a standard product, the decorative lamp 10 can be connected to one of the lamp bases 430 of the lamp string of different types and scenes, suitable for various environments. And the decorative lamp 10 can be replaced through the threaded light head 300 at any time, so the users can replace the decorative lamps 10 with different shape and the traditional lamps according to their demands, which is variety of used way and convenient to use.

Figure 8:
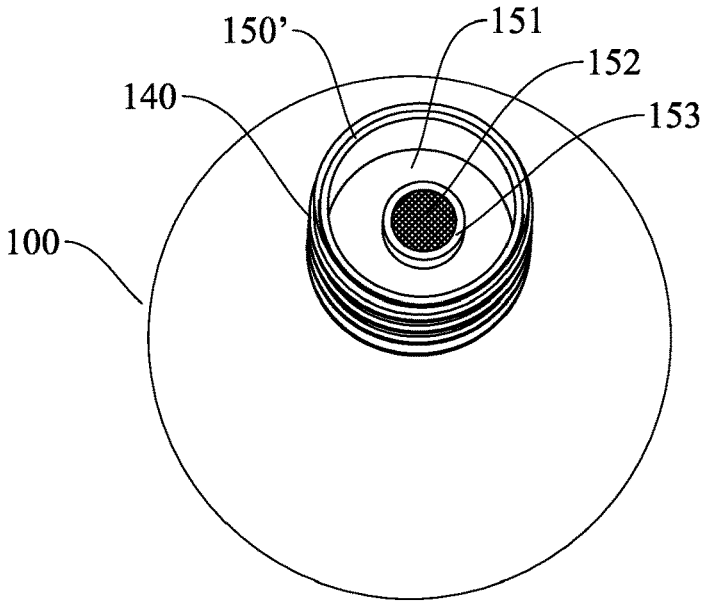
FIG. 8 shows a perspective view of the light shell and the second sealing plug of the decorative lamp according to the other embodiment in the present invention.
Figure 9:
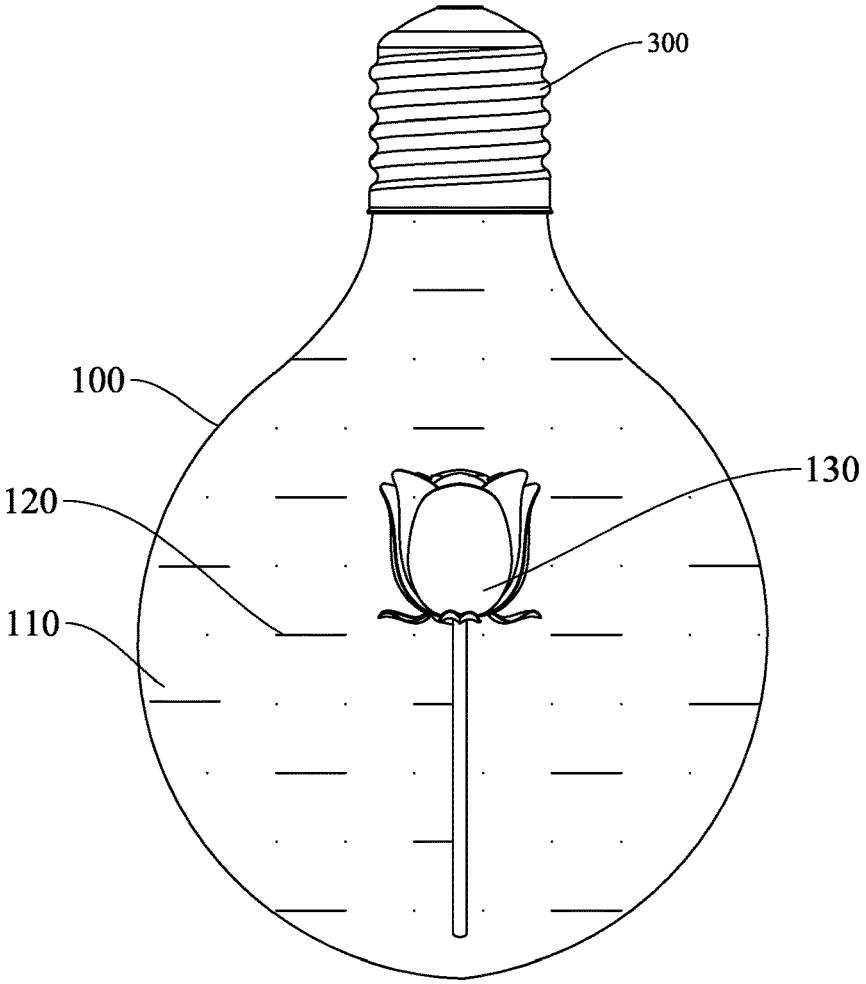
FIG. 9 shows a perspective view of the decorative lamp according to another embodiment in the present invention.
Figure 10:
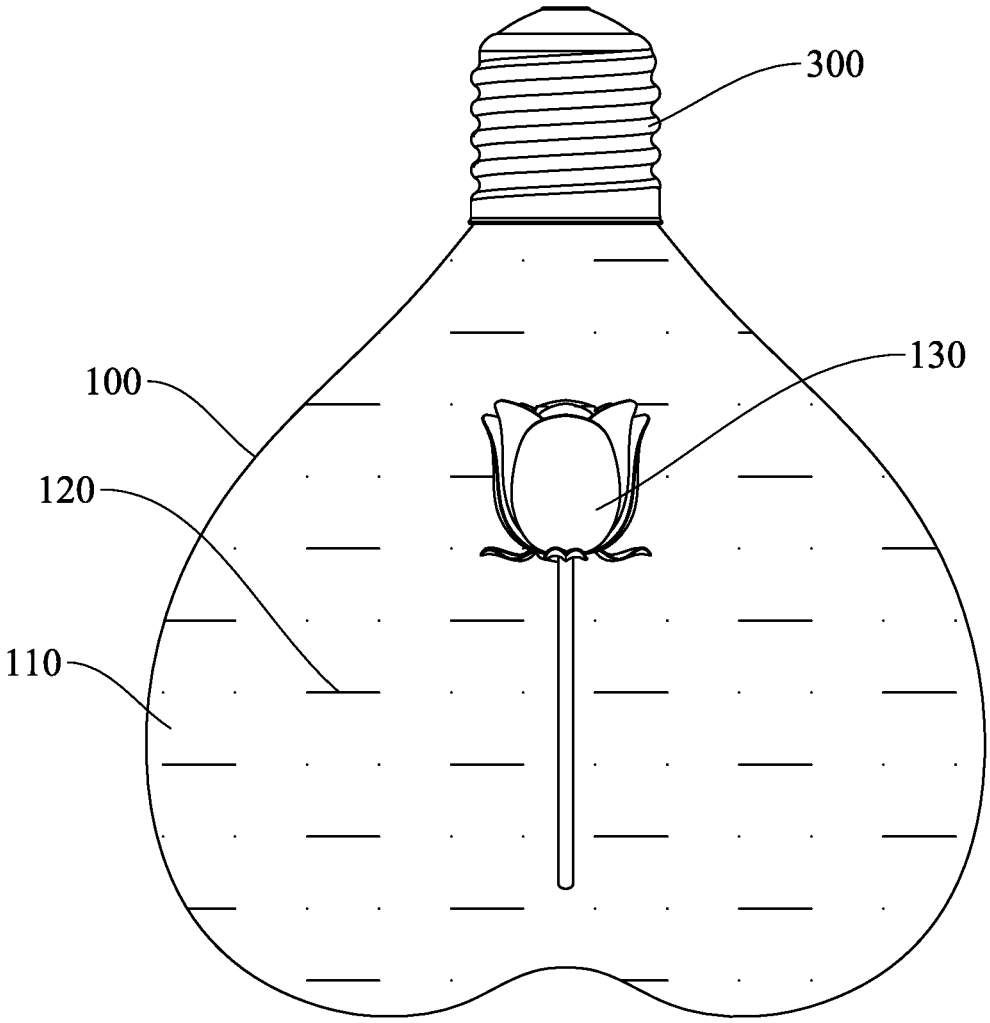
FIG. 10 shows a perspective view of the decorative lamp according to another embodiment in the present invention.

In another embodiment, referring to FIG. 6, FIG. 7 and FIG. 8, the second sealing plug 150' is provided with a mounting slot 151, the mounting slot 151 is depressed in a direction toward the cavity 110, the power board 200 is mounted in the mounting slot 151 of the second sealing plug 150', the space is reasonable used, the structure is compact. At the same time, the first LED lamp beads 210 which on the power board 200 is closer to the medium 120 and the decorative piece 130 in the cavity 110. The decorative piece 130 and the medium 120 combined with the light will product a better light effect.

Further, the second sealing plug 150' can be sealed with the connecting ring 140 by a surplus-card bonding, glue bonding, welding, or fusion, etc, which has a better sealing effect.

Further, the power board 200 may be fixed in the mounting slot 151 by clamping bonding, or adhering bonding, which is easy for installation.

Further, referring to FIG. 6, FIG. 7 and FIG. 8, a bottom of the mounting slot 151 is provided with a through hole 152 communicated with the cavity 110, which is connected with a sealing block 153. The through hole 152 is used for putting the medium 120 (water, oil or gel) to cavity 110. The sealing block 153 can be sealed with the wall of the through hole 152 by a surplus-card bonding, glue bonding, welding, or fusion, etc. The sealing block 153 is made of rubber or silicone, which is not limited herein.

Specifically, the decorative piece 130 is put into the cavity 110 by the connecting ring 140, then the second sealing plug 150' is inserted into the connecting ring 140 and sealed therein, the medium 120 is put into the cavity 110 through the through hole 152. Then the sealing block 153 is used to seal the through hole 152 and the cavity 110 is vacuumed. Finally, the second sealing plug 150' is connected to the connecting ring 140 and the sealing block 153 is connected to the through hole 152 by ultrasonic welding, and the semi-finished products decorative lamp 10 is obtained. Then the power board 200 is assembled in the mounting slot 151, and the threaded light head 300 is assembled on the connecting ring 140 to obtain the finished products decorative lamp 10.

Further, referring to FIG. 6, FIG. 7 and FIG. 8, an edge of the second sealing plug 150' extends outwardly with an annular limiting portion 154 against the opening 141 of the connecting ring 140. When assembly, the second sealing plug 150' is inserted into the connecting ring 140, the annular limiting portion 154 and the opening 141 of the connecting ring 140 is against to limit the second sealing plug 150' to be mounted in a designated position, achieving positioning assembly.

In another embodiment in the present invention, referring to FIG. 6, FIG. 7 and FIG. 8, the second sealing plug 150' is in a U shape and is inserted in the connecting ring 140, and the side wall of the second sealing plug 150' is sealing against with the inner wall of the connecting ring 140. Of course, in some other embodiment, the second sealing plug 150' can be in a circle shape, or any other shapes, only if it can sealed the connecting ring 140, the shape of the second sealing plug 150' is not limited herein.

In another embodiment in the present invention, referring to FIG. 6, FIG. 7 and FIG. 8, an outer wall of the connecting ring 140 is provided with an outer thread 142, which is adapted to the inner thread of the threaded light head 300, for easy assembly, and for secure connection.

In another embodiment in the present invention, the medium 120 is water, oil, crystalloid, glue, liquid, etc. Preferably, the medium 120 is water, the cost of water is low, which can reduce the cost of the decorative lamp 10. And water has the advantage of flame retardant, cooling and heat dissipation, which makes the decorative lamp 10 to be not easy to burn in a high temperature environment and to be high safety.

Figure 11:
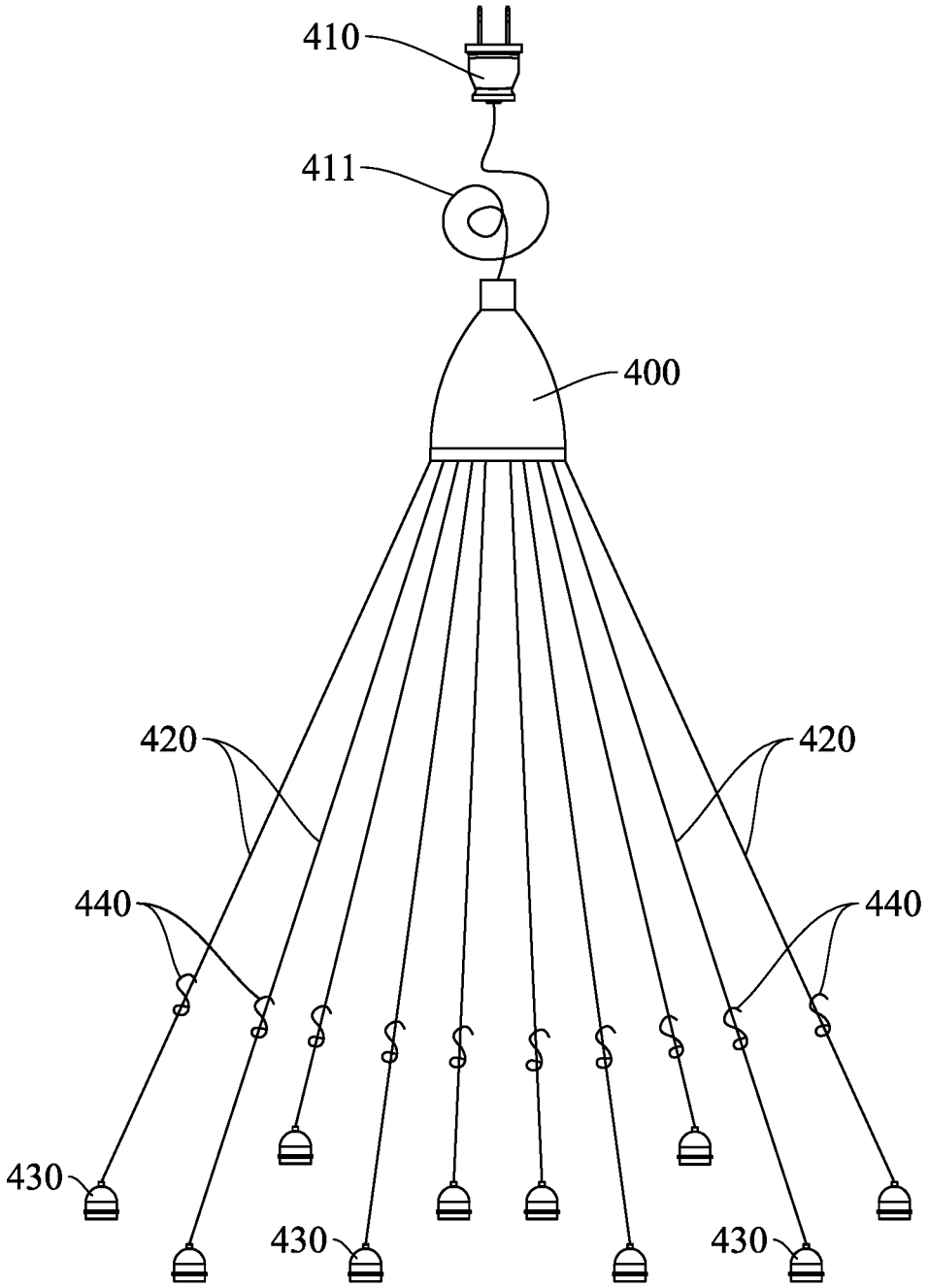
FIG. 11 shows a perspective view of the lamp string according to an embodiment in the present invention.
Figure 12:
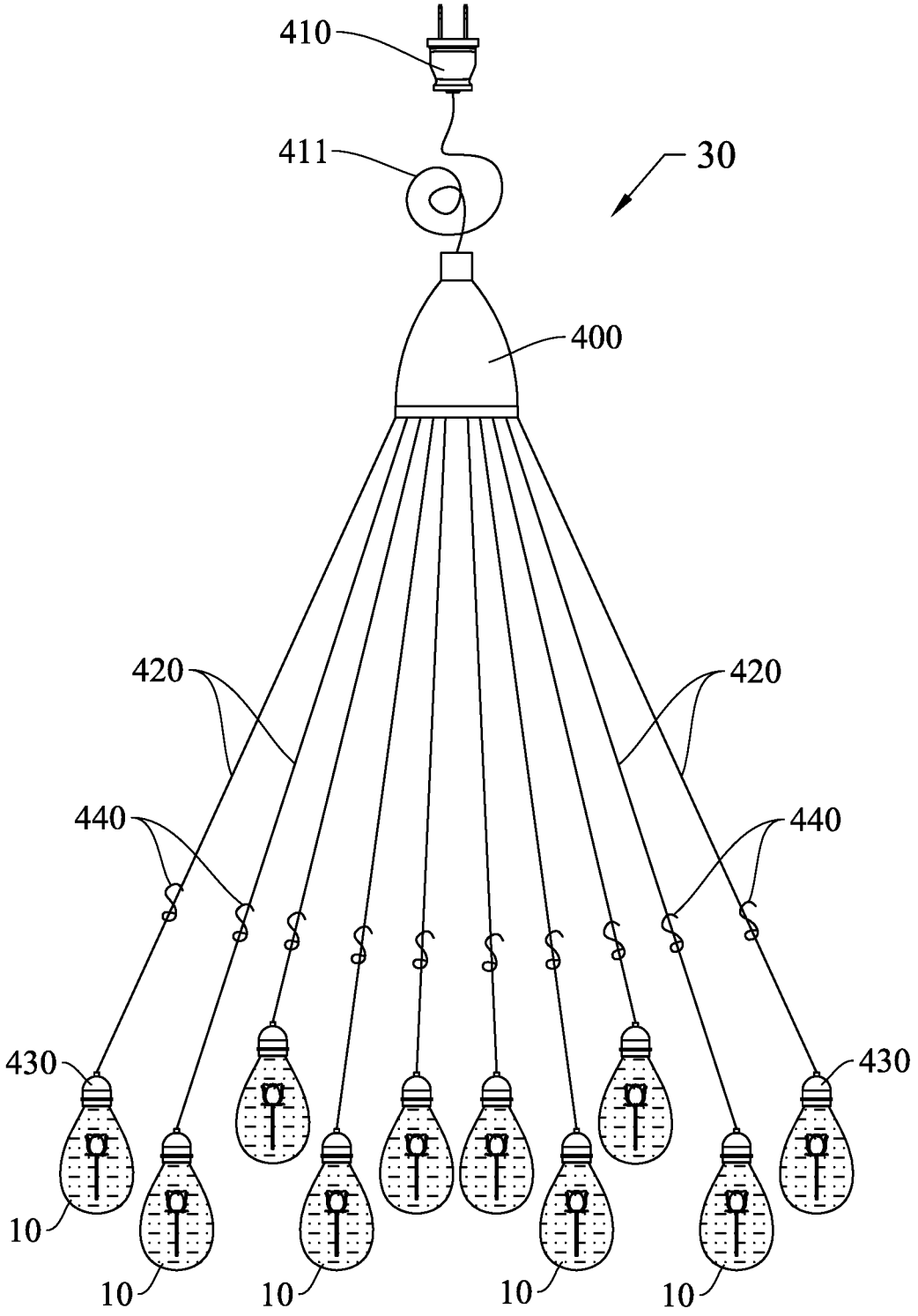
FIG. 12 shows a perspective view of the lamp string and the decorative lamps according to an embodiment in the present invention.

In another embodiment in the present invention, referring to FIG. 5, FIG. 11 and FIG. 12, it discloses a lamp string 30 with the decorative lamp 10. The outer thread of the threaded light head 300 and the inner thread of the lamp base 430 are adapt to connect, the decorative lamp 10 is connected to the lamp base 430 of the lamp string 30. The lamp string 30 can be all kinds, which is not limited herein.

In another embodiment in the present invention, referring to FIG. 11 and FIG. 12, the lamp string 30 includes a multi-wire conductor 400 and a plurality of the decorative lamps 10 described above. One end of the multi-wire conductor 400 has multiple wires 420, the other end thereof has a plug 410 electrically connected to the multiple wires 420, each of the wires 420 is connected with one of the lamp bases 430, each of the lamp bases 430 is electrically connected to one of the threaded light heads 300 of the decorative lamps 10 or one of the traditional lamps.

Specifically, referring to FIG. 11 and FIG. 12, the plurality of the decorative lamps 10 are respectively connected to a plurality of the lamp bases 430 to form a lamp string. The number of the decorative lamps 10 and that of the lamp bases 430 are not limited herein. The lamp string has simple structure and is easy to assemble.

In addition, the lamp string 30 is suitable for all kinds of scenes, indoor or outdoor, the decorative effect is better and the assembly process is simple, which greatly reduced the assembling cost.

The number of the lamp base 430 is two or more, which is not limited herein.

The lamp base 430 of lamp string 30 can be connected to any bulb which have a the threaded light head 300, not limited to the invention of decorative bulb 10.

Figure 15:
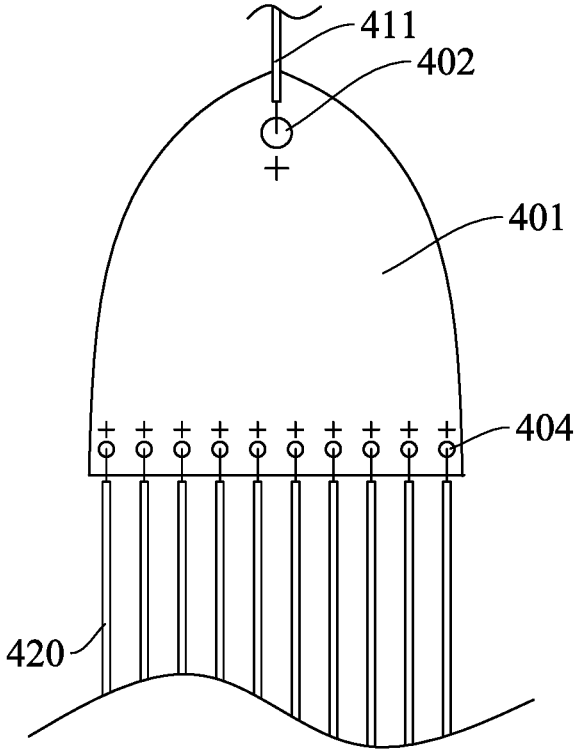
FIG. 15 shows a front view of the circuit board according to an embodiment in the present invention.
Figure 16:
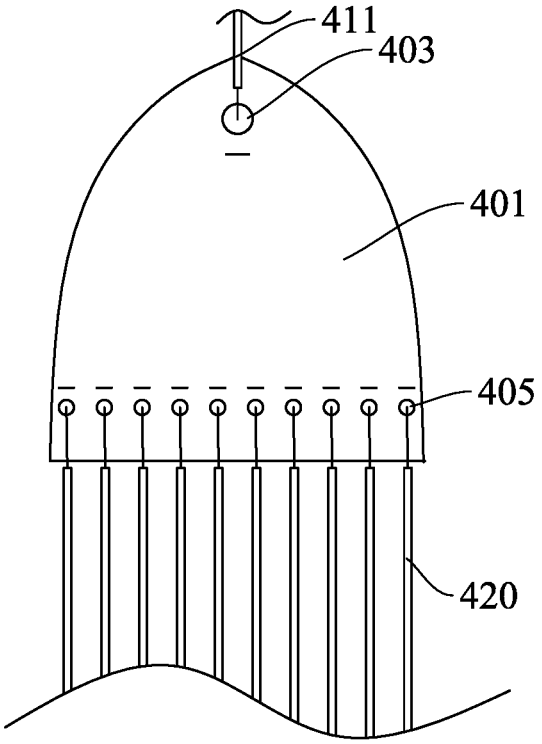
FIG. 16 shows a rear view of the circuit board according to an embodiment in the present invention.

Further, referring to FIG. 11, FIG. 15 and FIG. 16, the multi-wire conductor 400 is provided with a circuit board 401, one end of the circuit board 401 is provided with a first positive weld hole 402 and a first negative weld hole 403. A positive electrode and a negative electrode of a cable 411 of the plug 410 are welded to the first positive weld hole 402 and the first negative weld hole 403, respectively. The other end of the circuit board 401 is provided with a plurality of second positive weld holes 404 and a plurality of second negative weld holes 405, a positive electrode and a negative electrode of each of the wires 420 are welded to one of the second positive weld holes 404 and one of the second negative weld holes 405. The multi-wire conductor 400 is simple in structure, easy to assemble, easy in production and processing, which is greatly reducing labor and material costs.

It should be understood that all of the first positive weld hole 402, the first negative weld hole 403, the second positive weld holes 404, the second negative weld holes 405 are electrically connected with the circuit board 401.

Figure 13:
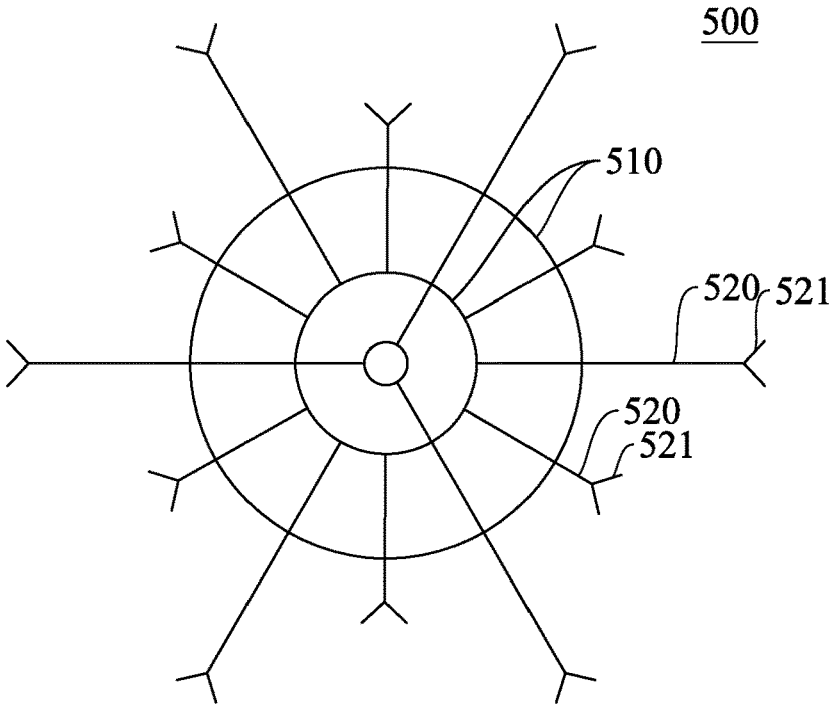
FIG. 13 shows a perspective view of the multi-foot bracket according to an embodiment in the present invention.
Figure 14:
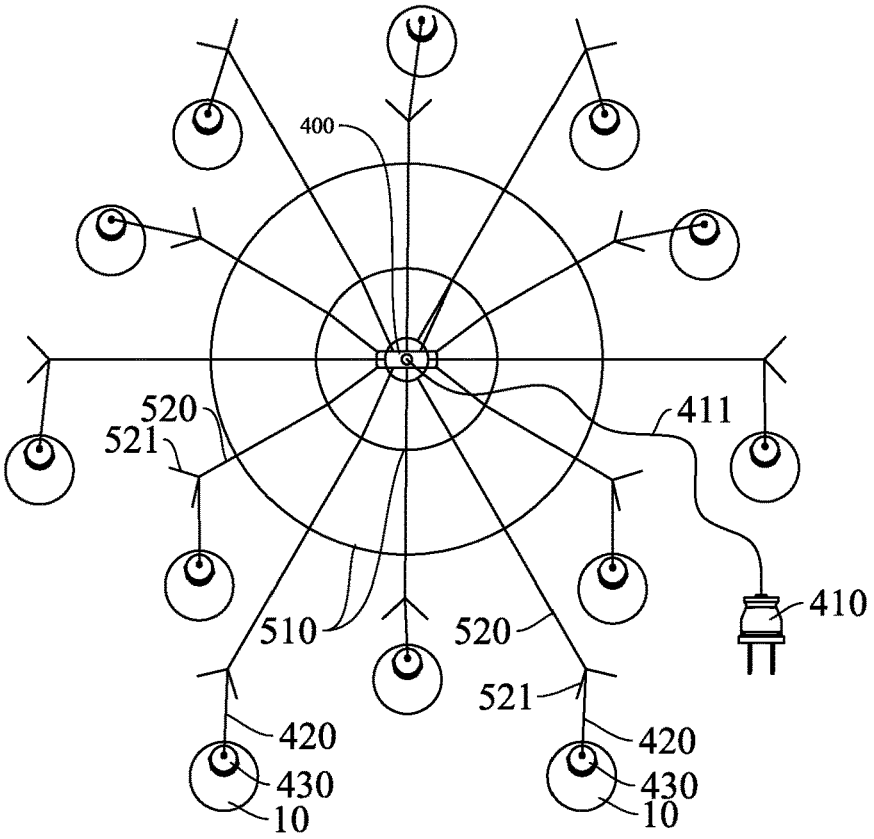
FIG. 14 shows a perspective view of the decorative lamp string mounted on the multi-foot bracket according to an embodiment in the present invention.

In another embodiment in the present invention, referring to FIG. 12, FIG. 13, FIG. 14, the lamps string also includes a multi-foot bracket 500 with a mounting frame 510, the mounting frame 510 extends around it with multiple branches 520, the multi-wire conductor 400 is arranged on the mounting frame 510 with at least one of the wires 420 hanging on one of the branches 520 so that multiple of the decorative lamps 10 distributed above or under the multi-foot bracket 500. The multi-foot bracket 500 can be hung on all kinds of scenes through a connector, such as hook, or lope, etc. The lamp string is presented through the above structure to decorate and beatify the environment and use diversified.

The lengths of the multiple branches 520 can be the same or different, the multiple branches 520 also can be arranged one long and one short in order, which is not limited herein.

Further, referring to FIG. 12, FIG. 13 and FIG. 14, one end of each of the branches 520 far away from the mounting frame 510 is provided with a fork 521, each of the forks 521 hangs at least one of the wires 420. The wires 420 are stably hung through the forks 521, the structure is stable.

Further, referring to FIG. 12, FIG. 13 and FIG. 14, each of the wires 420 is provided with at least one S-shaped hook 440, which is hung on the branches 520 so that the wires 420 can be connected with the branches stably and is neatly wired. In other embodiment, the hung 440 can be hung on tree branches or buildings.

Specifically, one end of the S-shaped hook 440 is adapt to connect with one of the wires 420, such as clamped connection or adhere connection, the other end thereof can hang on objects such as the branches 520, trees or buildings.

In the embodiment, the power board 200 and the circuit board 401 can be arranged by PLC or integrate chips according to the needs of actual production. Since the power board 200 and the circuit board 401 are both mature technologies in the prior art, that how the power board 200 and the circuit board 401 control the decorative lamp 10 and the string lamp 30 to work should be familiar and skilled in the art, so the control principle of the decorative lamp and the string lamp will not be described here.

The rest features of the lamp string is the same as the art lamp 20, and the features not explained in the lamp string are explained in the art lamp 20, and will not be repeated herein.

Figure 17:
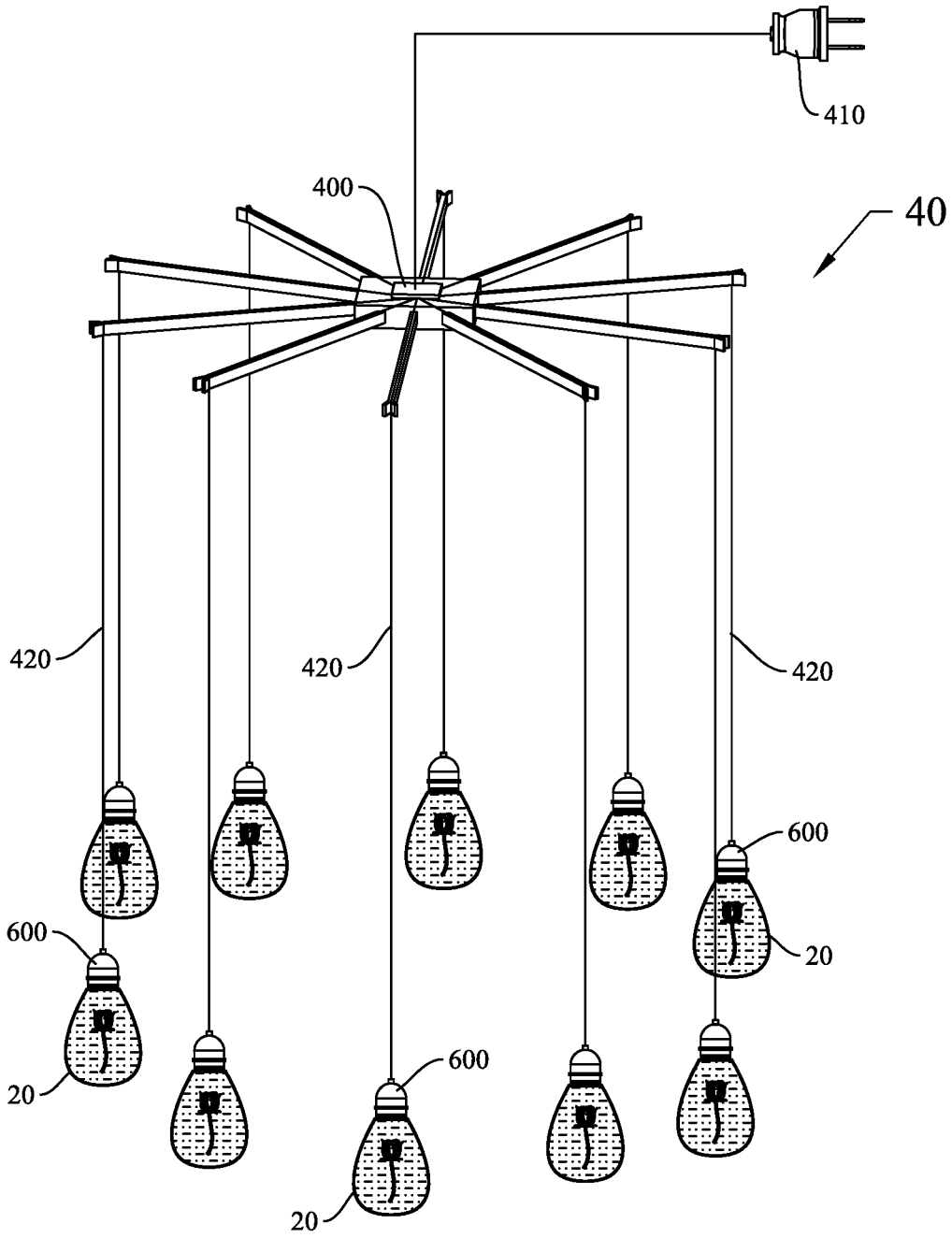
FIG. 17 shows a perspective view of the lamp string and the art lamps according to an embodiment in the present invention.

Referring to FIG. 17, another lamp string 40 includes a multi-wire conductor 400 and a plurality of the art lamps 20 described above. One end of the multi-wire conductor 400 has multiple wires 420, the other end thereof has a plug 410 electrically connected to the multiple wires 420, each of the wires 420 is connected with one of the light heads 600 of the art lamps 20 or one of the traditional lamps.

The rest features of the lamp string 40 is the same as the lamp string 30, and the features not explained in the lamp string are explained in the lamp string 30, and will not be repeated herein.

The above content is a further detailed explanation of the present invention in combination with the specific preferred embodiment, and it cannot be determined that the specific implementation of the present invention is limited to these instructions only. For ordinary technicians in the technical field of the present invention, the architectural form can be flexible and a series of products can be derived without departing from the idea of the present invention. Only several simple deductions or replacements shall be deemed to fall within the patent protection of the scope determined by the submitted claims of the present invention.

What is claimed is:

1. An art lamp, comprising:

a light head, provided with a power board with a top surface and a bottom surface, said top surface and said bottom surface is provided with several first LED lamp beads;

a wire, passing through a top of said light head to connect with said power board and power said first LED lamp beads; and, a light shell, detachably connected with said light head and filled with a transparent liquid or gel-like medium, at least one decorative piece is placed in said medium; said light shell is a transparent shell, a translucent shell, or a white fluorescent shell;

said first LED lamp beads illuminate said light head, said medium and said decorative piece;

said light shell is provided with a threaded port, a concave lens is sealed with an inner wall of said threaded port with a concave surface thereof orienting toward an opening of said threaded port.

2. The art lamp according to claim 1, wherein said light head is made from transparent, half-transparent material or white fluorescent shell, a light of said first LED lamp beads passes through said light head.

3. The art lamp according to claim 1, wherein a top of said light head is provided with a wire column and a column cap; said wire column extends into said light head, said wire column is provided with a wire hole; said column cap is provided with a cap hole, said column cap covers said wire column, said wire passes through said cap hole, an outer wall of said wire attaches to said wire hole and enters said light head; said column cap is filled of sealing glue to seal a gap between said wire hole and said wire and a gap between said column cap and said wire column, thereby sealing said connection of said light head and said wire.

4. The art lamp according to claim 1, wherein said concave lens is disposed on a first sealing plug, which is sealing connection with an inner wall of the threaded port.

5. The art lamp according to claim 4, wherein said concave lens is provided with an exhaust vent and a sealing block matched with said exhaust vent, said sealing block seals said exhaust vent.

6. The art lamp according to claim 1, wherein a centre of said power board is provided with a hole, said wire passes through said hole to be welded on said power board.

7. The art lamp according to claim 1, wherein said power board is clamped with an inner wall of said light head.

8. The art lamp according to claim 3, wherein an outer wall of said wire column is provided with a hook, said column cap is provided with an avoiding position at said corresponding hook so that said hook can extend out of said column cap.

9. The art lamp according to claim 1, wherein said wire includes a transparent wire shell and a positive wire, a negative wire and an emitting wire arranged in said transparent wire shell; said positive wire and said negative wire are wrapped with a protective insulating layer, said emitting wire includes a transparent protective layer and a second LED lamp beads arranged in said transparent protective layer; said positive wire, said negative wire are electrically connected with said second LED lamp beads and said power board.

10. A lamp string, comprising a multi-wire conductor and a plurality of art lamps according to claim 1, one end of said multi-wire conductor has multiple wires, the other end thereof has a plug electrically connected to said multiple wires, each of said wires is connected with one of said light heads of said art lamps;

wherein each of said plurality of art lamps, comprising:

a light head, provided with a power board with a top surface and a bottom surface, said top surface and said bottom surface is provided with several first LED lamp beads;

a wire, passing through a top of said light head to connect with said power board and power said first LED lamp beads; and, a light shell, detachably connected with said light head and filled with a transparent liquid or gel-like medium, at least one decorative piece is placed in said medium; said light shell is a transparent shell, a translucent shell, or a white fluorescent shell;

said first LED lamp beads illuminate said light head, said medium and said decorative piece;

said light shell is provided with a threaded port, a concave lens is sealed with an inner wall of said threaded port with a concave surface thereof orienting toward an opening of said threaded port.

11. A decorative lamp, comprising:

a light shell, having a cavity full of medium, a decorative piece is placed in said medium, an end of said light shell is provided with a connecting ring, a second sealing plug is arranged in said connecting ring and sealed with a port of said connecting ring;

a power board, arranged in said port, a surface thereof oriented to said decorative piece is provided with at least one LED light; and, a threaded light head, covering said port, and electrically connected with said power board;

said light shell is provided with a threaded port, a concave lens is sealed with an inner wall of said threaded port with a concave surface thereof orienting toward an opening of said threaded port.

12. The decorative lamp according to claim 11, wherein said second sealing plug is provided with a mounting slot, said power board is mounted in said mounting slot.

13. The decorative lamp according to claim 12, wherein a bottom of said mounting slot is provided with a through hole communicated with said cavity, which is connected with a sealing block.

14. The decorative lamp according to claim 13, wherein an edge of said second sealing plug extends outwardly with an annular limiting portion against said opening of said port.

15. A lamp string, comprising a multi-wire conductor and a plurality of decorative lamps according to claim 11, one end of said multi-wire conductor has multiple wires, the other end thereof has a plug electrically connected to said multiple wires, each of said wires is connected with a lamp base, each of said lamp base is electrically connected to one of said threaded light heads of said decorative lamps;

wherein each of said plurality of decorative lamps, comprising:

a light shell, having a cavity full of medium, a decorative piece is placed in said medium, an end of said light shell is provided with a connecting ring, a second sealing plug is arranged in said connecting ring and sealed with a port of said connecting ring;

a power board, arranged in said port, a surface thereof oriented to said decorative piece is provided with at least one LED light; and, a threaded light head, covering said port, and electrically connected with said power board;

said light shell is provided with a threaded port, a concave lens is sealed with an inner wall of said threaded port with a concave surface thereof orienting toward an opening of said threaded port.

16. The lamp string according to claim 15, wherein further comprising a multi-foot bracket with a mounting frame, said mounting frame extends around it with multiple branches, at least one of said wires hangs on one of said branches so that multiple of said lamp distributed on said multi-foot bracket.

17. The lamp string according to claim 16, wherein one end of each of said branches far away from said mounting frame is provided with a fork, each hanging at least one of said wires.

18. The lamp string according to claim 15, wherein said multi-wire conductor is provided with a circuit board, one end of said circuit board is provided with a first positive weld hole and a first negative weld hole; a positive electrode and a negative electrode of a cable of said plug are welded to said first positive weld hole and said first negative weld hole, respectively; said other end of said circuit board is provided with a plenty of second positive weld holes and a plenty of second negative weld hole, a positive electrode and a negative electrode of each of said wires are welded to one of said second positive weld holes and one of said second negative weld hole respectively.

* * * * *